US010159994B2

(12) United States Patent
Sanwald

(10) Patent No.: US 10,159,994 B2
(45) Date of Patent: Dec. 25, 2018

(54) SPRAY-COATING GUN FOR SPRAY COATING OBJECTS WITH COATING POWDER

(71) Applicant: GEMA SWITZERLAND GMBH, St. Gallen (CH)

(72) Inventor: Marco Sanwald, Abtwil (CH)

(73) Assignee: GEMA SWITZERLAND GMBH, St. Gallen (CH)

( * ) Notice: Subject to any disclaimer, the term of this patent is extended or adjusted under 35 U.S.C. 154(b) by 574 days.

(21) Appl. No.: 14/779,964

(22) PCT Filed: Jan. 21, 2014

(86) PCT No.: PCT/EP2014/051115

§ 371 (c)(1),
(2) Date: Sep. 24, 2015

(87) PCT Pub. No.: WO2014/154373

PCT Pub. Date: Oct. 2, 2014

(65) Prior Publication Data

US 2016/0051996 A1 Feb. 25, 2016

(30) Foreign Application Priority Data

Mar. 26, 2013 (DE) ..... 10 2013 205 362

(51) Int. Cl.
*B05B 15/50* (2018.01)
*B05B 12/14* (2006.01)
(Continued)

(52) U.S. Cl.
CPC ..... *B05B 5/032* (2013.01); *B05B 15/50* (2018.02); *B05B 5/0418* (2013.01); *B05B 7/14* (2013.01); *B05B 7/24* (2013.01); *B05B 12/14* (2013.01)

(58) Field of Classification Search
CPC ..... B05B 5/032; B05B 5/0418; B05B 15/05; B05B 15/02; B05B 12/14; B05B 7/14;
(Continued)

(56) References Cited

U.S. PATENT DOCUMENTS 3,536,580 A * 10/1970 La Fave ..... B05B 5/04 118/308
5,697,559 A * 12/1997 Davis ..... B05B 3/1064 239/224

(Continued)

FOREIGN PATENT DOCUMENTS

DE 10147858 A1 4/2003
DE 69529497 T2 10/2003

(Continued)

OTHER PUBLICATIONS

The German Office Action dated Jan. 21, 2014 for German Application No. 102013205362.2.

(Continued)

*Primary Examiner* — Jason Boeckmann
*Assistant Examiner* — Joseph A Greenlund
(74) *Attorney, Agent, or Firm* — Kinney & Lange, P.A.

(57) ABSTRACT

The present invention relates to a spray-coating gun for the spray coating of objects with coating powder. The front end region of the spray-coating gun has a coating-powder spray head and the opposite, rear end region of said spray-coating gun has a coating-powder connection and at least one compressed-gas connection. Coating powder can be supplied via the coating-powder connection to a coating-powder channel extending to the coating-powder spray head, while compressed gas can be supplied via the at least one compressed-gas connection to at least one compressed-gas channel extending to the front end region of the spray-coating gun. In order to optimize the coating quality which can be (Continued)

achieved with the spray-coating gun, it is provided according to the invention that the compressed-gas channel has at least one compressed-gas branch via which at least some of the compressed gas added to the compressed-gas channel is supplied to the coating-powder channel in order to adjust a powder/air mixture necessary for atomizing at the coating-powder spray head and/or for homogenizing the coating powder supplied to the coating-powder channel.

14 Claims, 5 Drawing Sheets

(51) Int. Cl.

| | |
|---|---|
| ***B05B 7/14*** | (2006.01) |
| ***B05B 7/24*** | (2006.01) |
| ***B05B 5/03*** | (2006.01) |
| *B05B 5/04* | (2006.01) |

(58) Field of Classification Search
CPC ..... B05B 7/24; B05B 7/1459; B05B 7/1486; B05B 7/1481
USPC ..... 239/398, 690, 704, 708; 118/323
See application file for complete search history.

(56) References Cited

U.S. PATENT DOCUMENTS

| | | | | |
|---|---|---|---|---|
| 6,712,291 | B2 * | 3/2004 | Mauchle | B05B 5/032 239/289 |
| 7,150,585 | B2 * | 12/2006 | Kleineidam | B05B 7/1459 406/50 |
| 7,410,329 | B2 * | 8/2008 | Simontacchi | B65G 53/28 406/109 |
| 7,793,869 | B2 * | 9/2010 | Mather | B05B 5/032 239/690 |
| 7,997,878 | B2 * | 8/2011 | Fulkerson | B05B 7/1459 417/86 |
| 8,123,147 | B2 * | 2/2012 | Fulkerson | B05B 5/032 118/621 |
| 8,162,570 | B2 * | 4/2012 | Mauchle | B05B 7/1454 406/13 |
| 2005/0126476 | A1 * | 6/2005 | Shutic | B05B 5/032 118/308 |
| 2005/0229845 | A1 | 10/2005 | Mather et al. | |
| 2008/0277507 | A1 | 11/2008 | Fulkerson et al. | |
| 2015/0053797 | A1 * | 2/2015 | Fulkerson | B05B 7/1463 239/704 |

FOREIGN PATENT DOCUMENTS

| | | | |
|---|---|---|---|
| DE | 102005006522 | B3 | 8/2006 |
| DE | 202006015697 | U1 | 3/2007 |
| DE | 102006019643 | A1 | 10/2007 |
| DE | 20071049219 | A1 | 4/2009 |
| EP | 1297899 | A1 | 4/2003 |
| WO | 9406516 | A1 | 3/1994 |
| WO | 2008150790 | A1 | 12/2008 |
| WO | 2009027805 | A1 | 3/2009 |
| WO | 2013154702 | A1 | 10/2013 |
| WO | 2014161717 | A1 | 10/2014 |
| WO | 2014161718 | A1 | 10/2014 |

OTHER PUBLICATIONS

The International Search Report dated Mar. 19, 2014 for International Application No. PCT/EP/2014/055442.
The International Search Report dated Apr. 9, 2014 for International Application No. PCT/EP2014/051115.
English translation of International Preliminary Report on Patentability dated Sep. 29, 2015 for corresponding PCT Application No. PCT/EP2014/051115.

* cited by examiner

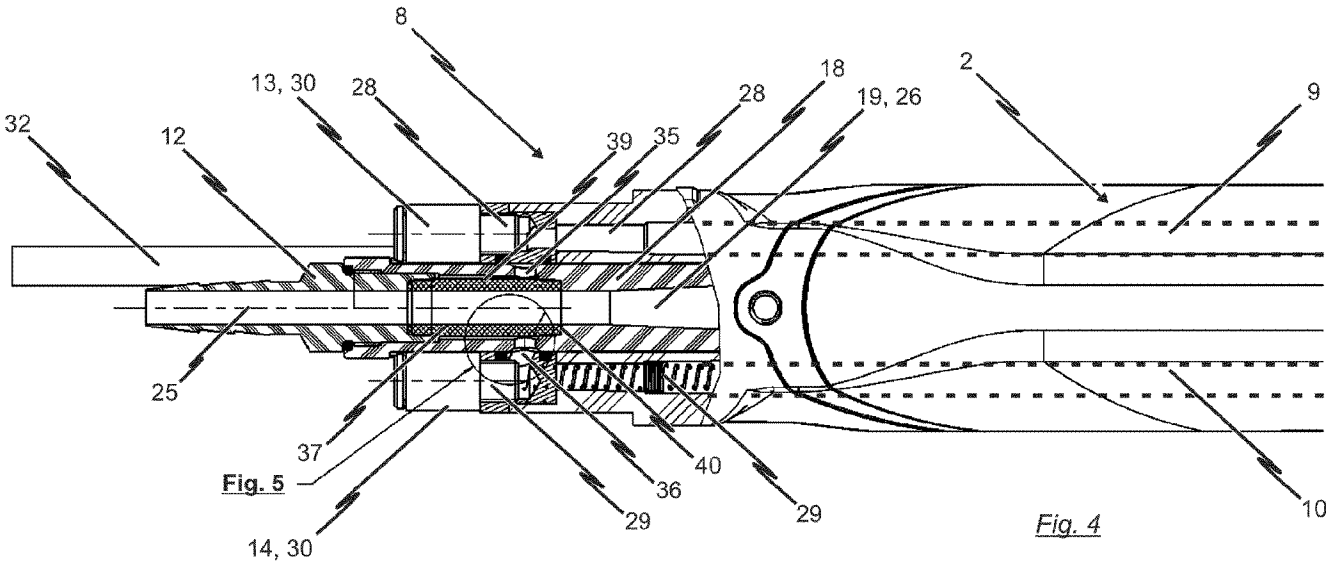
Fig. 4
Fig. 5
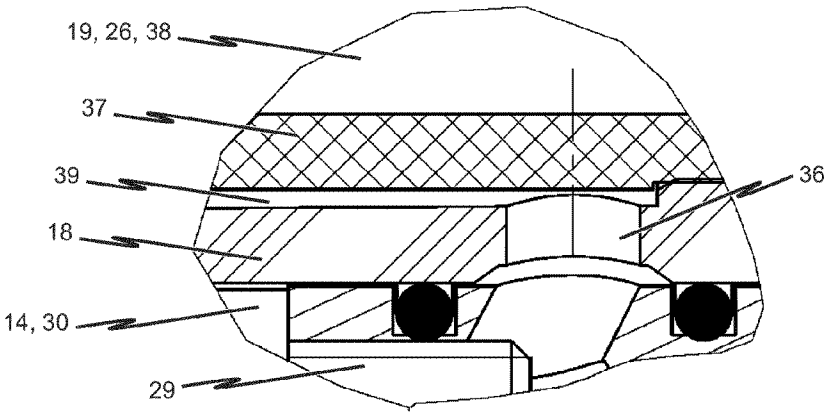
Fig. 5

SPRAY-COATING GUN FOR SPRAY COATING OBJECTS WITH COATING POWDER

BACKGROUND

The present invention relates to a spray-coating gun.

Accordingly, the invention relates in particular to a spray-coating gun for spray coating objects with coating powder, wherein the spray-coating gun has a coating powder spray head at its front end region for spraying coating powder and a coating powder connection as well as at least one compressed gas connection at its opposite rear end region. Coating powder can be supplied to a coating powder channel extending to the coating powder spray head via the coating powder connection of the spray-coating gun. Compressed gas, particularly compressed air, can be supplied to a compressed gas channel extending to the front end region of the spray-coating gun via the at least one compressed gas connection of the spray-coating gun.

The invention relates in particular to spray-coating guns for coating powder conveyed pneumatically in a compressed air flow. The coating material is sprayed through a material discharge outlet of the coating powder spray head at the front end region of the spray-coating gun. The material discharge outlet can for example be formed by a material channel outlet with or without a transverse deflector (impact head or the like), by a nozzle or by a rotating atomizer element.

The coating material is preferably electrostatically charged by static electricity and/or by a high voltage of more than 1000 volts, for example a voltage in the range of between 10,000 and 140,000 volts, in order to thereby achieve better adhesion to the preferably grounded object to be coated and to reduce waste.

The spray-coating gun according to the invention can be a manual or an automatic powder spraying device comprising a spray nozzle or a rotating atomizer.

When the spray-coating gun is in operation, a coating powder line is connected to the gun's coating powder connection, by means of which the coating powder to be sprayed is supplied to the spray-coating gun for example from a powder reservoir or a powder container.

There are different ways in which the coating powder to be sprayed can be supplied to the spray-coating gun and the coating powder conveyed through the coating powder line.

In particular, a powder dispensing device, usually also called a powder injector, can be used for this purpose. With such a powder injector, the coating powder is pumped out of a powder container by means of conveying compressed air and fed to the coating powder connection of the spray-coating gun. In so doing, a mixture of conveying compressed air and powder flows through a powder channel of a diffuser inside the powder injector, whereby additional dosing air is added to the powder/conveying air mixture via the diffuser in order to obtain a defined total air flow.

Fresh powder is supplied to the powder container as needed via a fresh powder line from a supplier container with which the powder supplier supplies fresh powder to the powder user. The powder forms a compact mass in the supplier container. In contrast to that, the coating powder in the powder container is to be in a fluidized state so that it can be for example aspirated by the suction effect of a powder injector and supplied to the spraying device in a flow of compressed air.

On the other hand, however, it is also conceivable to use at least one powder pump to supply the coating powder to be sprayed to the spray-coating gun and to convey the coating powder through the coating powder line.

For example, the EP 1 551 558 A1 printed publication describes a powder pump having a first powder chamber and a second powder chamber arranged parallel to the first powder chamber. The powder chambers of this known prior art powder pump are respectively limited on both the inlet-side as well as the discharge-side by a mechanical pinch valve arrangement. It is thereby specifically provided for the powder hoses connected to the respective powder chambers to be able to be deformed by a mechanically operated punching tool in the inlet-side or discharge-side area of the powder pump respectively in order to squeeze or open the hose section as needed. The powder chambers of the known pump each further have a gas-permeable filter element. A negative pressure can be separately set in each powder chamber by means of a vacuum connection, in consequence of which coating powder can be sucked into the powder chamber via the intake-side end region of the respective powder chamber. The pinch valve provided at the intake-side end region of the powder chamber is then subsequently closed and the pinch valve provided at the discharge-side end region of the powder chamber opened. Upon application of positive pressure in the powder chamber, the coating powder previously sucked into the powder chamber is then discharged back out of the powder chamber via the discharge-side end region.

Summary

The invention is designed to solve the task of further developing a spray-coating gun of the type specified at the outset to the extent of optimizing the coating quality which the spray-coating gun is able to achieve independently of the coating powder feed.

According thereto, the invention proposes a spray-coating gun having a coating powder spray head at its front end region for spraying coating powder and a coating powder connection as well as at least one compressed gas connection at its opposite rear end region. Coating powder can be supplied to a coating powder channel extending to the coating powder spray head via the coating powder connection of the spray-coating gun while compressed gas can be supplied to a compressed gas channel extending to the front end region of the spray-coating gun via the at least one compressed gas connection of the spray-coating gun.

In order to ensure that the coating quality able to achieved by the spray-coating gun is always optimal irrespective of the way in which the coating powder to be sprayed is supplied to the coating powder connection of the spray-coating gun, the invention provides for the compressed gas channel extending to the front end region of the spray-coating gun to comprise at least one compressed gas branch line via which at least a portion of the compressed gas supplied to the compressed gas channel is fed to the coating powder channel extending to the coating powder spray head. By so doing, the coating powder supplied to the coating powder channel can be sufficiently homogenized. Additionally, the powder/air mixture needed for the atomizing at the coating powder spray head of the gun can be optimally set.

In other words, the inventive solution enables additional air to be fed into the coating powder channel of the spray-coating gun in the form of compressed gas in a simple to realize and yet effective manner in order to ensure that the coating powder fed to the coating powder channel is always able to be atomized. The present invention inasmuch enables the feeding of the coating powder into the spray-coating gun, the coating powder channel respectively, at relatively high density. Sufficient homogenization of the coating powder fed into the coating powder channel as well as setting the necessary and optimal powder/air mixture for the atomizing at the coating powder spray head of the gun is effected by the additional air introduced from the compressed gas channel into the coating powder channel via the compressed gas branch line.

The inventive solution in particular ensures that an optimal spray coating result can always be achieved with the spray-coating gun irrespective of the way in which the coating powder is supplied to the spray-coating gun. The spray-coating gun can spray plastic as well as also enamel powder, same being supplied to the spray-coating gun for example by an injector pump or a dense phase pump.

Of particular advantage according to the inventive solution is feeding the additional compressed air into the coating powder channel at the rear end region of the spray-coating gun. This measure ensures that the additional compressed air introduced into the coating powder channel can be mixed with the coating powder introduced into the coating powder channel over a sufficiently long enough distance as to have a particularly homogeneous powder/air mixture at the front end of the coating powder channel; i.e. at the coating powder spray head, which is a condition for the most uniform possible atomizing of the coating powder at the powder discharge outlet of the coating powder spray head.

Research has shown that this is surprisingly not achievable when the additional compressed air is not supplied to the coating powder to be atomized until further downstream, for example at the front end of the coating powder channel or into the coating powder spray head itself.

Advantageous further developments of the inventive spray-coating gun are set forth in the dependent claims.

Thus, one particularly preferential realization of the inventive solution provides for a filter element which is permeable to compressed gas but not coating powder in the compressed gas branch line. This can effectively prevent coating powder from entering into the compressed gas channel; i.e. counter to the feed direction of the compressed gas. This ensures that no coating powder can accumulate in the compressed gas lines of the spray-coating gun such that cleaning the spray-coating gun becomes a very easy process. In particular, the inventive spray-coating gun allows for changing powder within the shortest possible time frame.

According to a further aspect of the inventive solution, it is provided for the spray-coating gun to have a shaft housing comprising a front and a rear end region, whereby the coating powder spray head is affixed or affixable to the front end region of the shaft housing. Formed in the shaft housing is the at least one compressed gas channel which extends at least partly through the shaft housing in the longitudinal direction of the shaft housing.

In preferential embodiments, the spray-coating gun not only has a shaft housing but also a connecting piece. The connecting piece is affixed or affixable at the rear end region of the shaft housing for the connection of at least one compressed gas line and preferably comprises a through-hole in the longitudinal direction of the shaft housing. In the present example embodiment, a tube-like, hollow affixing element is particularly provided for affixing the connecting piece to the shaft housing.

It is hereby conceivable for the tubular hollow affixing element to be inserted or insertable into the through-hole of the connecting piece in the longitudinal direction of the shaft housing. Preferably, the tubular hollow affixing element is designed to mechanically tension the connecting piece toward the shaft housing in its inserted state in the through-hole of the connecting piece.

In conjunction hereto, it is conceivable for the hollow affixing element to comprise a coupling region for coupling to the shaft housing and a forward-facing clamping surface with which the connecting piece can be tensioned toward the shaft housing by the coupling of the hollow affixing element to the shaft housing.

One conceivable realization of the hollow affixing element utilized in the inventive solution provides for same to be a hollow screw, its coupling region having a thread to screw into a thread disposed on the shaft housing.

The tubular hollow affixing element designed for example as a hollow screw has a through-channel in the shaft housing's longitudinal direction. Coating powder can be supplied to the coating powder channel of the spray-coating gun extending to the coating powder spray head through this through-channel configured in the hollow affixing element.

In conjunction hereto, it is conceivable for the shaft housing to be made of a plastic material, whereby the coating powder channel extending to the coating powder spray head and/or the compressed gas channel extending to the front end region of the spray-coating gun is/are formed in the plastic material of the shaft housing.

Alternatively hereto, it is however of course also conceivable for the coating powder channel extending to the coating powder spray head to be formed by a coating material tube insertable into the shaft housing in the longitudinal direction of said shaft housing. When—as in the latter embodiment—the coating powder channel of the spray-coating gun is formed by a coating material tube, it is advantageous for said coating material tube to be affixable in the spray-coating gun by means of the tubular hollow affixing element.

As noted above, preferential realizations of the inventive spray-coating gun provide for same to comprise a shaft housing as well as a connecting piece affixed or affixable to the rear end region of the shaft housing.

Providing such a connecting piece has in particular the advantage of having the rear part of the spray-coating gun being replaceable, wherein a corresponding connecting piece dependent particularly on the type of the coating powder feed is affixed on the shaft housing of the spray-coating gun. So doing always ensures that there is always coating powder capable of being atomized irrespective of the coating powder feed (e.g. an injector pump or a dense phase pump), which ensues as needed by supplying additional air to the coating powder channel via the compressed gas branch line.

The connecting piece inasmuch forms the interface of the spray-coating gun, whereby at least one compressed gas connection as well as a hose connection for coating powder are formed at the rear end region of the connecting piece. A connection or a channel for a low-voltage cable can moreover be provided at the rear end region of the connecting piece when the spray-coating gun comprises a high-voltage generator to generate the high electrical voltage needed for a high-voltage electrode to electrostatically charge the coating powder.

At least one compressed gas bore extends through the connecting piece, by way of which compressed gas can be supplied to the compressed gas channel formed in the shaft housing. When the connecting piece is fixed to the rear end region of the shaft housing, the front end of the compressed gas bore extending through the connecting piece is axially opposite the rear end of the at least one compressed gas channel formed in the shaft housing. This enables the compressed gas bore extending through the connecting piece to be fluidly connected to the at least one compressed gas channel formed in the shaft housing.

So that the additional air necessary for setting the optimal powder/air mixture for atomization or for the homogenization of the coating powder respectively can be supplied to the coating powder channel, it can be provided for the compressed gas bore extending through the connecting piece to likewise be fluidly connected to the through-channel running through the hollow affixing element, so as to thereby supply the compressed gas necessary in regulating the optimal powder/air mixture for atomization or for homogenization of the coating powder to the coating powder conveyed through the through-channel.

To prevent coating powder from being able to infiltrate into the compressed gas bore in the opposite direction of the compressed gas feed in the latter embodiment of the inventive spray-coating gun, a filter element made from microporous material which is permeable to compressed gas but not to coating powder is provided. Preferentially, the filter element forms at least a section of the wall of the through-channel running through the hollow affixing element.

It is hereby particularly conceivable for the filter element to be configured as a hollow cylinder and arranged coaxially as well as concentrically to the through-channel running through the hollow affixing element. The filter element is preferably accommodated in the through-channel of the hollow affixing element so as to be replaceable.

The following will reference the example embodiment of the inventive spray-coating gun depicted in the drawings in describing the invention in greater detail.

BRIEF DESCRIPTION OF THE DRAWINGS

The figures show:

FIG. 4 a partly sectional view of the rear end region of the example embodiment of the inventive spray-coating gun from below; and FIG. 5 a detail from FIG. 4 of the filter element made of microporous material accommodated in the through-channel of the hollow affixing element.

DETAILED DESCRIPTION

Figure 1A:
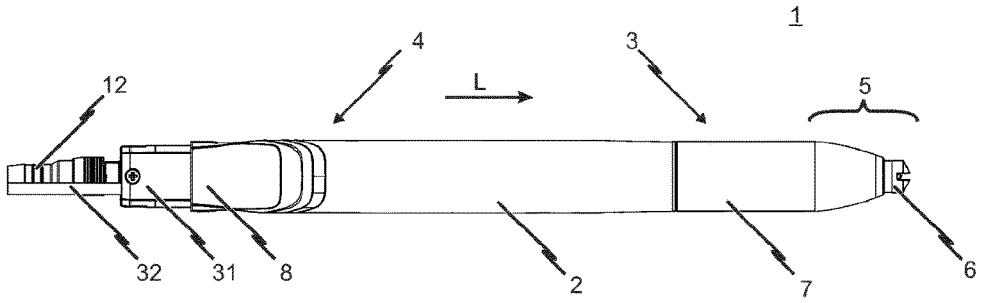
FIG. 1*a* a top plan view of an example embodiment of the spray-coating gun according to the invention.
Figure 1B:
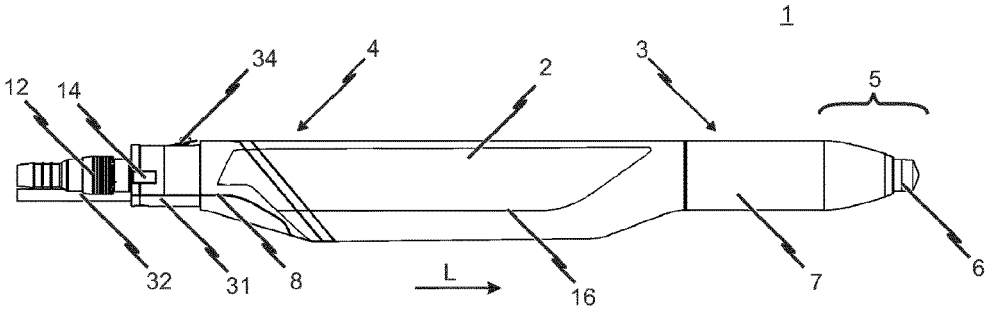
FIG. 1*b* a side view of the example embodiment of the inventive spray-coating gun.
Figure 1C:
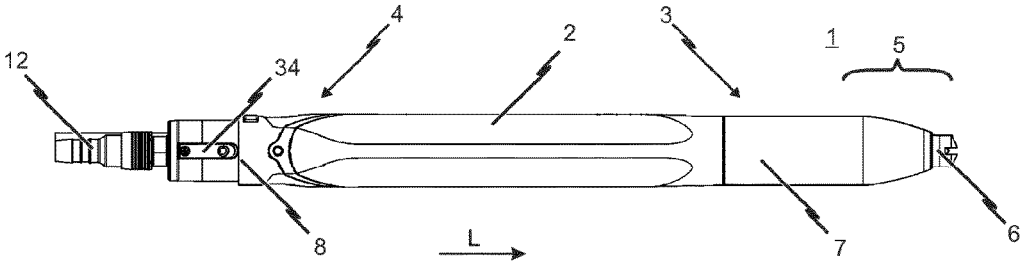
FIG. 1*c* a view of the example embodiment of the inventive spray-coating gun from below.
Figure 1D:
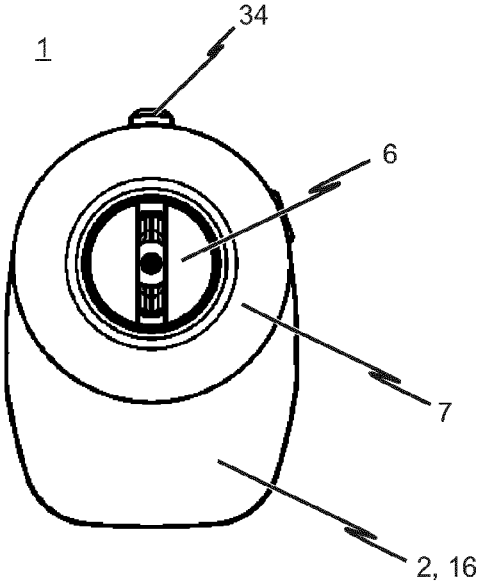
FIG. 1*d* a front view of the coating powder spray head of the example embodiment of the inventive spray-coating gun.
Figure 1E:
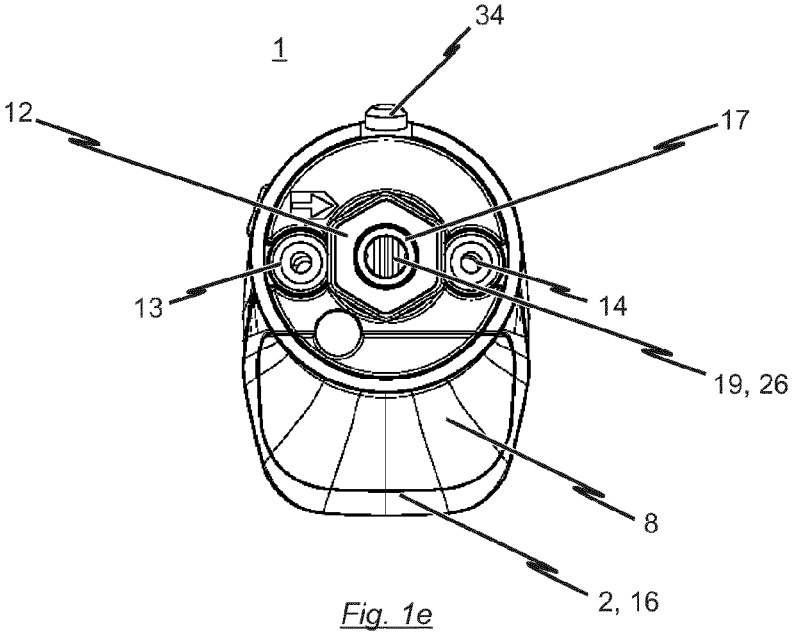
FIG. 1*e* a rear view of the connecting piece of the example embodiment of the inventive spray-coating gun.

The example embodiment of the spray-coating gun 1 according to the invention depicted in the drawings is preferably designed for spraying coating powder which is in particular conveyed pneumatically in a compressed air flow, for example by means of an injector pump or a dense phase pump.

The example embodiment of the inventive spray-coating gun 1 comprises a shaft housing 2 having a coating powder spray head 5 affixed or affixable to its front end region 3. The coating powder spray head 5 forms a coating material discharge outlet.

A connecting piece 8 is affixed or affixable to the rear end region 4 of the shaft housing 2. The connecting piece 8 serves to connect at least one compressed gas line, a coating powder line as well as an electrical low-voltage supply. To this end, two compressed gas connections 13, 14 as well as a coating powder connection 12, e.g. in the form of a hose connector, are provided at the rear end region of the connecting piece 8. A low-voltage cable 32 moreover extends through the connecting piece 8. The low-voltage cable 32 serves in supplying electrical energy to a high-voltage generator accommodated in a protrusion 16 of the shaft housing 2 which generates the high voltage required to operate a high-voltage electrode.

The connecting piece 8 comprises a through-hole 17 extending in the longitudinal direction L of the shaft housing 2. A tubular hollow affixing element 18 is accommodated in the through-hole 17 of the connecting piece 8 which forms a channel 26 for supplying coating powder to a coating powder channel 11 extending through the shaft housing 2 in the longitudinal direction L of said shaft housing 2.

It is hereby of advantage for the spray-coating gun to not have a replaceable or separate coating material tube insertable into the coating powder channel 11 formed in the shaft housing 2 so as to reduce the number of components in the spray-coating gun 1 to a minimum. The example embodiment of the spray-coating gun instead provides for forming at least the shaft housing 2 from a plastic material, whereby the coating powder channel 11 extending through the shaft housing 2 in the longitudinal direction L of the shaft housing 2 is configured in the plastic material of the shaft housing 2.

In an alternative version of the inventive spray-coating gun 1 which is not depicted in the figures, however, a separate coating material tube can be used to supply coating powder, same extending in the longitudinal direction L of the shaft housing 2 in the assembled state of the spray-coating gun.

The coating powder spray head 5 can comprise a nozzle 6, for example as is represented in FIGS. 1*a* to 1*d* and 2*b*, which is affixed to the front end region 3 of the shaft housing 2 by a cap nut 7.

The tubular hollow affixing element 18 accommodated in the through-hole 17 of the connecting piece 8 serves to affix the connecting piece 8 to the rear end region 4 of the shaft housing 2. In the example embodiment of the inventive spray-coating gun 1 depicted in the figures, the tubular hollow affixing element 18 is configured as a hollow screw.

The hollow affixing element 18 in the form of a hollow screw can be inserted through the through-hole 17 of the connecting piece 8 in the longitudinal direction L of the shaft housing 2 and preferably forms a sliding push-fit with the wall of the through-hole 17. The hollow affixing element 18 designed as a hollow screw has an axial through-hole 19 in the longitudinal direction L of the shaft housing 2. The axial through-hole 19 of the hollow affixing element 18 designed as a hollow screw forms a channel 26 for coating powder, wherein in the fully assembled state of the spray-coating gun 1, this coating powder channel 26 formed by the axial through-hole 19 axially aligns with the coating powder channel 11 formed in the shaft housing 2.

The transition between the coating powder channel 26 formed by the axial through-hole 19 and the coating powder channel 11 formed in the shaft housing 2 is preferably of continuous configuration in order to prevent powder residue from depositing during the operation of the spray-coating gun 1.

If, however, contrary to the example embodiment as depicted in the figures, a coating material tube is used to supply coating material, which is insertable into the shaft housing 2 of the spray coating gun 1, the rear end region of the coating material tube would then preferably be accommodated by the axial through-hole 19 of the hollow affixing element 18 configured as a hollow screw.

The hollow affixing element 18 configured as a hollow screw has a thread 20, preferably an external thread and preferably on the front end region of the hollow affixing element 18 configured as a hollow screw and serving to screw onto a thread 21 in the shaft housing 2 configured complementary thereto.

Specifically, it is provided in the example embodiment of the inventive spray-coating gun 1 depicted in the drawings for the hollow affixing element 18 configured as a hollow screw to comprise a forward-facing clamping surface 22 of a screw head 23 additionally to the thread 20. This clamping surface 22 allows the connecting piece 8 to be clamped in the direction of the shaft housing 2. The forward-facing clamping surface 22 can hereby be clamped against a rear-facing end face 24 or against a rear-facing transverse surface of the connecting piece 8. The coating powder channel 11 extending through the shaft housing 2 in longitudinal direction L and the axial through-hole 19 of the hollow affixing element 18 configured as a hollow screw, which forms a channel 26 for coating powder aligned axially with the coating powder channel 11 configured in the shaft housing 2, have a common central longitudinal axis 25.

The inner wall of the axial through-hole 19 of the hollow affixing element 18 configured as a hollow screw at least partly forms the entire extent of the coating powder channel 26 extending through the connecting piece 8 in the longitudinal direction L of the shaft housing 2.

The shaft housing 2 is preferably a one-piece material body made of plastic. In accordance with other embodiments, it could also be of multi-piece design and/or consist of another electrically conductive or preferably electrically insulating material.

The thread 21 of the shaft housing 2 for fixing the hollow affixing element 18 designed as hollow screw is preferably formed by the shaft housing 2 itself. Alternatively hereto, however, it also conceivable for a thread body to be rotationally fixed in the shaft housing 2 for this purpose.

The connecting piece 8 is preferably likewise a one-piece body, preferably metal, so that it is electrically conductive and can be used as electroconductive path connectable to a ground potential. In accordance with other embodiments, the connecting piece 8 can however also be comprised of electrically non-conductive material, particularly plastic.

The hollow affixing element 18 designed as a hollow screw defines the position of the coating powder connection 12 relative to the connecting piece 8 and thereby also relative to the shaft housing 2 and supports the coating powder connection 12, which in the example embodiment of the inventive spray-coating gun 1 depicted in the drawings is designed as a hose connector. On the other hand, the hollow affixing element 18 designed as a hollow screw further defines the position of the coating powder channel 26 extending through the connecting piece 8 relative to said connecting piece 8 and thus also the position of the coating powder channel 11 formed in the shaft housing 2. A different tube-like hollow affixing element 18 can be used in place of a hollow screw to detachably fix the connecting piece 8 at the rear end region 4 of the shaft housing 2.

That said, a differently configured coupling section can be provided in place of a thread 20 at the front end region of the hollow affixing element 18, which is able to couple with a compatible, preferably complementarily configured coupling member of the shaft housing 2 (formed by the shaft housing 2 or inserted into or fixed therein). For example, one of the two hollow affixing element 18 or shaft housing 2 components can be designed as a plug coupler and the other component as a plug socket. It is hereby preferable for the coupling section of the hollow affixing element 18 to be configured as a male plug and the coupling member of the shaft housing 2 as the coupler. One of these two can comprise a catch or other locking element which can snap in to a locking area running in transverse direction to the coating powder channel. For example, one of the two components can be provided with a cross pin which can insert into an L-shaped groove formed on the other component in the longitudinal direction of the coating powder channel and is then rotatable, similar to a bayonet coupling.

In all of the embodiments, the connection of the hollow affixing element 18, which is configured in the example embodiment of the inventive spray-coating gun 1 depicted in the drawings as a hollow screw, and is releasable and detachable in the shaft housing 2 so that the hollow affixing element 18 can be separated from the shaft housing 2 and thus also extracted from the connecting piece 8, is made such that all three components can be separated from one another, for example for cleaning purposes and/or for replacing with other parts.

In the example embodiment of the inventive spray-coating gun 1 depicted in the drawings, a hose connector 12 is inserted from the rear into the axial through-hole 19 of the hollow affixing element 18 configured as a hollow screw and accordingly fixed. The hose connector 12 forms the coating powder connection, via which coating powder can be supplied to the coating powder channel 26/11 extending in the longitudinal direction L of the shaft housing 2.

The hose connector 12 has a rearward-projecting insertion section 27 for the inserting of a coating material hose. It is hereby further conceivable for the hose connector 12 to have an end section slotted from the rear to the front which divides the slot into fingers able to be clamped to the coating material hose by a tension ring.

The connecting piece 8 has an outer circumference at its front end which is identical to the outer circumference of the rear end region 4 of the shaft housing 2.

It is however in principle also conceivable for the front end outer circumference of the connecting piece 8 to be for example smaller than the circumference of the rear end region 4 of the shaft housing 2. Other circumference ratios are likewise possible. It is then of advantage to make use of an adapter fitting having a front end adapted to the circumference of the shaft housing 2 and a rear end adapted to the circumference of the connecting piece 8. The adapter fitting can be axially fixed between a front-facing transverse surface of the connecting piece 8 and a rear-facing end face of the shaft housing 2 by the hollow affixing element 18 designed as a hollow screw and serves to adapt the circumferential shape and size of the rear end section 4 of the shaft housing 2 to the circumferential shape and size of the front end section of the connecting piece 8.

In the example embodiment of the inventive spray-coating gun 1 depicted in the drawings, however, the front end section of the connecting piece 8 conforms in shape and size to the rear end section 4 of the shaft housing 2 such that no adapter fitting is necessary.

As FIG. 4 depicts, at least one compressed gas channel 9, 10 longitudinally traversing the shaft housing 2 of the example embodiment of the inventive spray-coating gun 1 is preferably formed. In the shaft housing 2 of the example embodiment, two compressed gas channels 9, 10 running along both sides adjacent to the coating powder channel formed in the shaft housing 2 are provided. The rear end of each compressed gas channel 9, 10 is axially opposite the front end of a compressed gas bore 28, 29 formed in the connecting piece 8. The two compressed gas bores 28, 29 extend longitudinally through the connecting piece 8 and have a thread 30 at the rear end for a connection nipple of a (not shown) compressed gas hose or for a screw plug.

In the example embodiment of the inventive spray-coating gun 1 depicted in the figures, a total of two compressed gas bores 28, 29 are formed in the connecting piece 8, arranged on both sides of the hollow affixing element 18 designed as a hollow screw and the coating powder channel 26. A total of two compressed gas channels 9, 10 are correspondingly formed in the shaft housing 2 in the depicted example embodiment of the inventive spray-coating gun. One of the two compressed gas channels 9, 10 serves for example in supplying compressed air (or another gas) which flows across one or more high-voltage electrodes arranged downstream of, at or in the front end region 4 of the shaft housing 2 and supplies powder with high voltage from a high-voltage generator to electrostatically charge the coating material. The other compressed gas channel 10, 9 can be used to supply compressed air (or another gas) for another purpose, for example atomization or the forming and/or other influencing of the coating material flow through the coating powder channel 11.

Figure 2A:
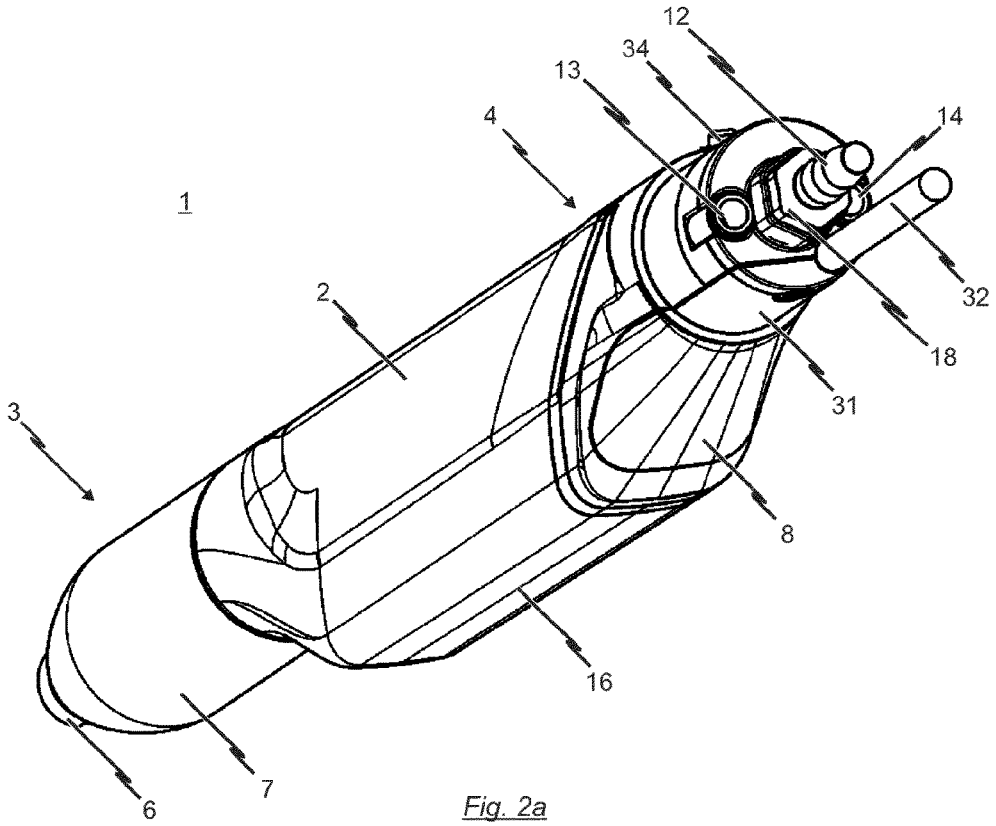
FIG. 2*a* a perspective rear view of the example embodiment of the inventive spray-coating gun.
Figure 2B:
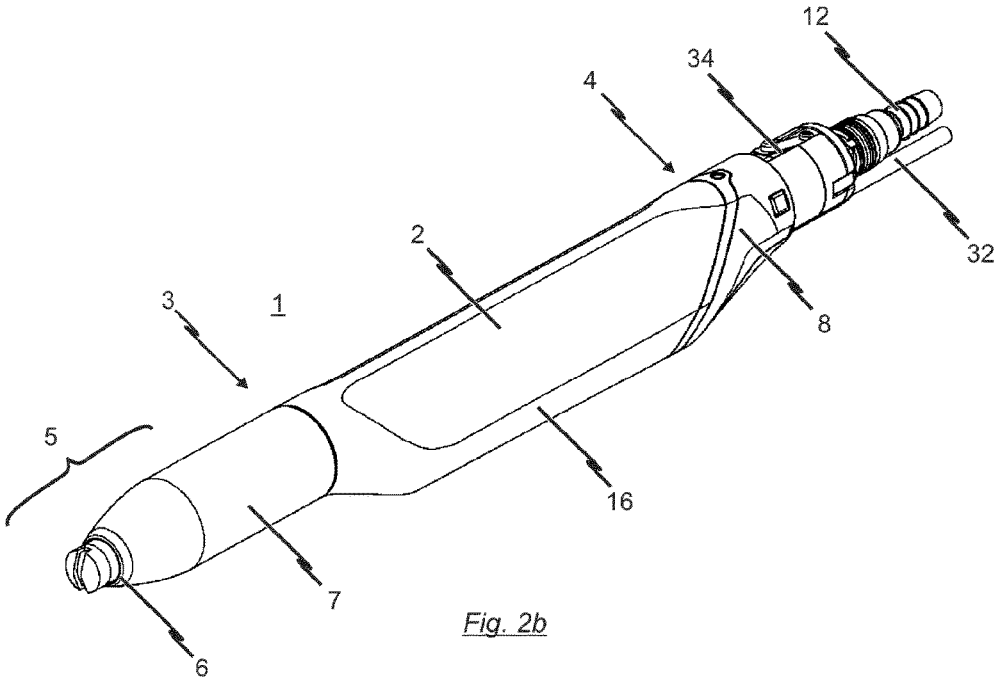
FIG. 2*b* a perspective front view of the example embodiment of the inventive spray-coating gun.
Figure 3:
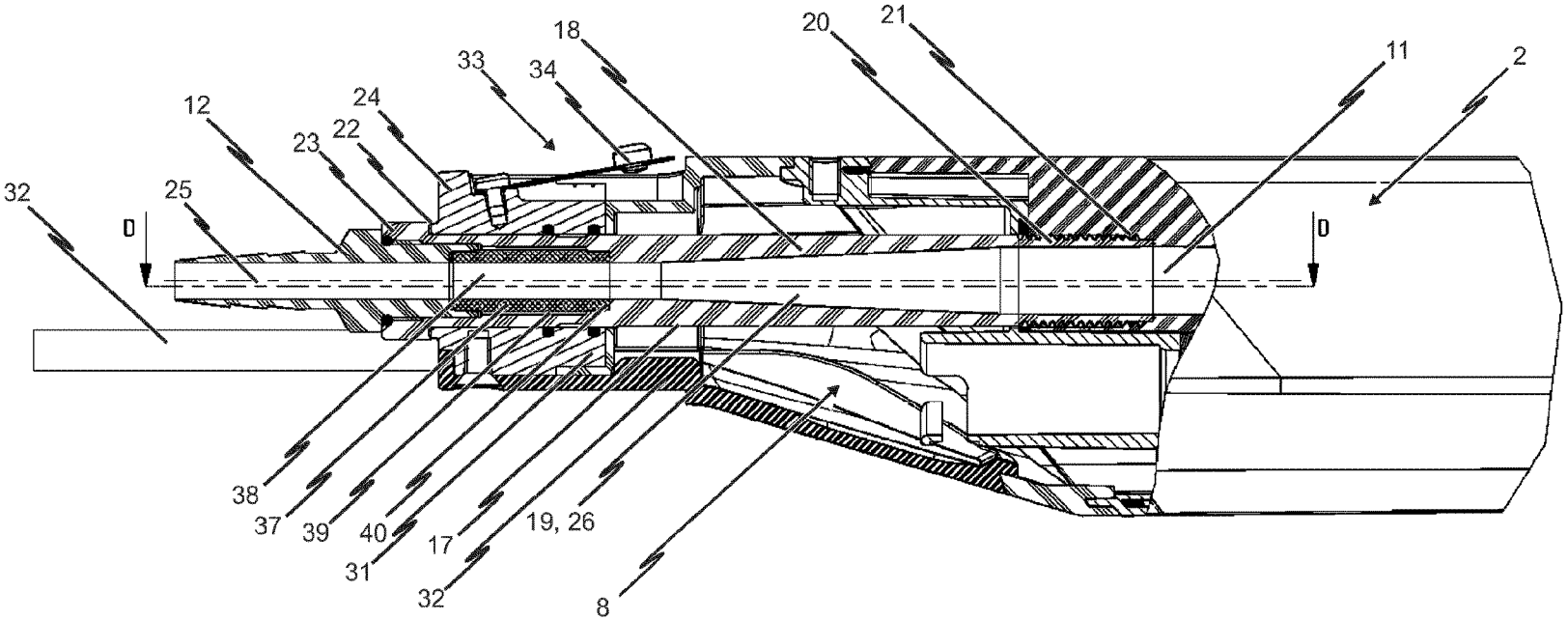
FIG. 3 a partly sectional side view of the rear end region of the example embodiment of the inventive spray-coating gun.

According for example to the FIG. 2*a* depiction, a part of the connecting piece 8 is designed as a fitting 31 for receiving and fixing a cable connecting element of a power cable 32. The fitting 31 extends in the longitudinal direction L of the shaft housing 2 parallel to the through-hole 17 into which the hollow affixing element 18 designed as a hollow screw is inserted.

The fitting 31 is preferably a through-hole formed in the connecting piece 8, preferably in the form of a socket for receiving the plug socket of the cable connecting element correspondingly configured as a plug. The cable connecting element can comprise at least one electrically conductive contact element on its front end for contacting at least one electrically conductive contact element provided on the rear end of the shaft housing 2 for the low-voltage feed from the cable 32 to the high-voltage generator. The cable connecting element preferably has a jacket made of electrically conductive material which connects on one side to an electrical grounding conductor in the cable 32 and on the other contacts the fitting 31 of the connecting piece 8 and is thus electroconductively connected to same.

According to one not-shown embodiment, the high-voltage generator is not accommodated in the shaft housing 2, and particularly in the protrusion 16 formed in the shaft housing 2, but rather external thereof. In this case, the cable 32 is not a low-voltage cable but rather a high-voltage cable which conducts high voltage into the shaft housing 2 from an external high-voltage generator and therein conducts it to the at least one high-voltage electrode via an electrical line.

In the example embodiment of the inventive spray-coating gun 1 depicted in the drawings, the connecting piece 8 is accorded a dual function: On the one hand, the connecting piece 8 serves as an interface enabling compressed gas, electrical energy and coating powder to be supplied to the spray-coating gun 1. On the other, the connecting piece 8 of the example embodiment depicted in the drawings is also accorded the function of fixing section for fixing on a (not shown) supporting element. It is hereby conceivable for the supporting element to comprise a tubular fixing section which can push-fit with the fixing section 33 of the connecting piece and then provide a wobble-free push-fit.

The (not shown in the figures) supporting element can be secured to the connecting piece 8 and particularly to the fixing section 33 of the connecting piece 8 axially and/or in the rotationally circumferential direction by a spring-biased catch 34, which for example comprises a catch head on a spring strip which is affixed to the connecting piece 8 and can snap into a transverse opening formed on the supporting element. The catch 34 locks into the transverse opening of the supporting element automatically upon the supporting element reaching its final axial and circumferential position when being push-fit onto the fixing section 33 of the connecting piece 8.

The (not shown in the figures) supporting element can be fixed to a support, for example a lifter support or a robotic arm or a handle.

In place of a supporting element limited by the length of the connecting piece 8, a tubular supporting element made of electrically insulating or preferably electrically conductive material protruding rearward beyond can be used, its front end region configured compatibly to the fixing section 33 of the connecting piece 8 and which can be detachably connected to said fixing section 33 of the connecting piece 8. It is thereby advantageous for the coating material supply line, which is connected or connectable to the hose connector 12 as well as all the other material supply and/or power supply lines, to extend through the tubular supporting element, particularly the power cable 32 and the compressed gas lines for the different compressed gases, e.g. compressed air, for which the compressed gas channels 9, 10 are for example provided in the shaft housing 2. A second connecting piece (in the same or a differing embodiment as the connecting piece 8 of the spray-coating gun 1) can be provided at the rear end of the tube-like supporting element, by means of which the tubular supporting element together with the spray coating gun can be mounted to a support.

As can be noted from the FIG. 4 representation, a total of two compressed gas channels extend in the longitudinal direction L of the shaft housing 2 in the example embodiment of the inventive spray-coating gun 1. These compressed gas channels are each formed by a compressed gas channel 9, 10 formed in the shaft housing 2 as well as a compressed gas bore 28, 29 correspondingly configured in the connecting piece 8 and likewise extending in the longitudinal direction L of the shaft housing 2.

In order to ensure that independent of the way in which coating powder is supplied to the spray-coating gun 1, the coating powder is always in an atomizable state at the coating powder spray head 5 of the spray-coating gun 1, the spray-coating gun 1 according to the invention provides for additional air being able to be introduced into the coating powder channel 11.

To this end, it is for example provided in the example embodiment of the inventive spray-coating gun 1 depicted in the drawings for at least one of the two compressed gas bores 28, 29 configured in the connecting piece 8 to be fluidly connected to the coating powder channel 26 running through the hollow affixing element 18 designed as a hollow screw so as to supply compressed gas to the coating powder conveyed through the coating powder channel 26.

As can be noted from the FIGS. 4 and 5 representations, in the example embodiment of the inventive spray-coating gun 1, the fluid connection between the compressed gas bores 28, 29 on the one hand and the coating powder channel 26 on the other is formed by an additional compressed gas bore 35, 36 extending transverse to the longitudinal direction L of the shaft housing 2. These additional compressed gas bores 35, 36 are part of an additional compressed air inlet device which is integrated into the connecting piece 8 of the spray-coating gun 1 in the example embodiment of the inventive spray-coating gun 1 depicted in the drawings.

The additional compressed air inlet device comprises a filter element 37 (filter tube) configured as a hollow cylinder which, in the example embodiment depicted in the figures, encircles a partial length of the coating powder channel 26 configured in the tube-like hollow affixing element 18 by 360°, so that the coating powder can flow through the filter tube channel 38. Compressed gas, compressed air respectively, can flow from the two compressed gas bores 28, 29 configured in the connecting piece 8 to an annular compressed air chamber 39 encircling the outer circumference of the tubular filter element 37 via the additional compressed gas bores 35, 36. The additional compressed air can flow from the annular compressed air chamber 39 into the filter tube channel 38 through the tubular filter element 37. The tubular filter element 37 comprises microporous material so as to be permeable to air but not to coating powder.

The tubular filter element 37 preferably consists of a sintered body, for example of metal or plastic, or of a material mixture containing metal or plastic. It can also consist of a different material and/or be formed by a filter membrane.

The filter pores of the tubular filter element 37 are preferably formed in such a manner that compressed air supplied from the compressed gas bores 28, 29 via the additional compressed gas bores 35, 36 is routed into the powder path both in the circumferential direction as well as in the longitudinal direction of the powder path through a large powder path section. The micropores of the tubular powder element 37 can be radially or axially angled toward the powder path and/or run from the tubular powder element 37 into the filter tube channel 38 tangentially to the powder path circumference, directing the compressed air accordingly. The large inner circumferential surface of the tubular filter element 37 enables a small volume of additional compressed air to homogenize the axially distributed powder in the coating powder channel 26 and thus in the coating powder channel 11 formed in the shaft housing 2. This thereby prevents or at least reduces powder flow pulsations in the powder path. Powder density homogenization in the longitudinal direction and across the cross section of the powder path can furthermore be realized.

The length of the additional compressed air per unit of time can be kept short so that it has no or only a small influence on the flow rate of the coating powder in the coating powder channel 11. Another possibility of influencing the flow rate of the coating powder is by increasing the flow volume by increasing the pressure of the additional compressed air.

The additional compressed air can flow from the tubular filter element 37 into the filter tube channel 38 as a stream or in the form of small bubbles depending on the type of filter pores and the pressure of the additional compressed air.

The pressure of the additional compressed air supplied to the annular compressed air chamber 39 can be regulated by appropriately selecting the effective diameter for the additional compressed gas bores 35, 36. It is however also conceivable for the pressure of the additional compressed air to be varied by changing the pressure of the compressed gas supplied to the compressed gas bores 28, 29 (via compressed gas connections 13, 14).

The tubular filter element 37 of the additional compressed air inlet device integrated into the connecting piece 8 is to extend over at least 270° of the powder path circumference, preferably over the full 360° of the powder path circumference so as to extend around the powder path defined by the coating powder channel 26.

The length of the tubular filter element 37 preferably extends over at least 5 mm of the powder path length.

The tubular filter element 37 of the additional compressed air inlet device is preferably a rigid body. It can, however, also be a flexible body.

As can be seen in the FIG. 4 representation, in the example embodiment of the inventive spray-coating gun 1 depicted in the figures, the tubular filter element 37 is inserted into the axial through-hole 19 of the tube-like hollow affixing element 18 designed as a hollow screw from the rear. The front end region of the tubular filter element 37 thereby abuts up against a corresponding limiting surface 40 formed within the axial through-hole 19 of the hollow affixing element 18 designed as a hollow screw.

In the depicted embodiment of the inventive spray-coating gun 1, the rear end region of the filter element 37 is secured by the front end region of the hose connector 12 inserted into the axial through-hole 19 of the hollow affixing element 18. Other embodiments for fixing and positioning the tubular filter element 37 within the axial through-hole 19 of the hollow affixing element 18 designed as a hollow screw are however also conceivable.

It is of particular advantage for the filter element to be replaceably accommodated in the through-channel of the hollow affixing element.

According to a further preferential embodiment of the invention, the control unit can be advantageously designed such that it can regulate the amount of additional compressed air flowing through the additional compressed air inlet device per unit of time as a function of the required amount of powder in at least one of the following ways: e.g. manually adjustable and/or preferably automatically controllable or preferably adjustable.

The additional compressed air flow volume; i.e. the amount of additional compressed air introduced into the filter tube channel 38 and thus into the coating powder channel 26 via the filter element 37 per unit of time can be varied by replacing the filter element 37 accommodated in the axial through-hole 19 of the hollow affixing element 18 with a filter element having different pore size or air permeability respectively. The air permeability of the filter element 37 can also—if desired—be reduced to zero; the filter element 37 then needs to be replaced by an air-permeable cylinder element.

The invention is not limited to the example embodiment depicted in the drawings but rather yields from a synopsis of all the features disclosed herein together.

The invention claimed is:

1. A spray-coating gun for spray coating objects with coating powder, wherein the spray-coating gun has a coating powder spray head at its front end region for spraying coating powder and a coating powder connection as well as at least one compressed gas connection at its opposite rear end region, wherein coating powder can be supplied to a coating powder channel extending to the coating powder spray head via the coating powder connection, and wherein compressed gas can be supplied to at one least compressed gas channel extending to the front end region of the spray-coating gun via the at least one compressed gas connection, wherein:

the compressed gas channel comprises at least one compressed gas branch line via which at least a portion of the compressed gas supplied to the compressed gas channel is fed to the coating powder channel for setting the powder/air mixture necessary for the atomizing at the coating powder spray head and/or for homogenizing of the coating powder supplied to the coating powder channel wherein the spray-coating gun comprises:

a shaft housing comprising a front and a rear end region, wherein the coating powder spray head is affixed or affixable to the front end region of the shaft housing, and wherein at least one compressed gas channel is formed in the shaft housing which extends at least partly through the shaft housing in the longitudinal direction of the shaft housing;

a connecting piece which is affixed or affixable at the rear end region of the shaft housing for the connection of at least one compressed gas line and comprises a through-hole in the longitudinal direction of the shaft housing; and a tube-like, hollow affixing element for affixing the connecting piece to the shaft housing;

wherein the rear end of the at least one compressed gas channel is axially opposite the front end of a compressed gas bore extending through the connecting piece, wherein the compressed gas bore extending through the connecting piece is fluidly connected to the coating powder channel extending though the hollow affixing element for supplying compressed gas to the coating powder conveyed through the coating powder channel.

2. The spray-coating gun according to claim 1, wherein a filter element is provided in the compressed gas branch line which is permeable to compressed gas but not to coating powder.

3. The spray-coating gun according to claim 1, wherein the hollow affixing element is inserted or insertable into the through-hole of the connecting piece in the longitudinal direction of the shaft housing.

4. The spray-coating gun according to claim 3, wherein the hollow affixing element is designed to tension the connecting piece toward the shaft housing in its inserted state in the through-hole of the connecting piece.

5. The spray-coating gun according to claim 1, wherein the hollow affixing element comprises a coupling region for coupling to the shaft housing and a forward-facing clamping surface with which the connecting piece can be tensioned toward the shaft housing by the coupling of the hollow affixing element to the shaft housing.

6. The spray-coating gun according to claim 5, wherein the hollow affixing element is a hollow screw, its coupling region having a thread for screwing into a thread disposed on the shaft housing.

7. The spray-coating gun according to claim 1, wherein the hollow affixing element comprises a through-channel in the longitudinal direction of the shaft housing, wherein coating powder can be supplied to the coating powder channel extending to the coating powder spray head through the through-channel.

8. The spray-coating gun according to claim 1, wherein a filter element made from microporous material which is permeable to compressed gas but not to coating powder is provided to prevent coating powder from infiltrating into the compressed gas bore in the opposite direction of the compressed gas feed.

9. The spray-coating gun according to claim 1, wherein the filter element forms at least a section of the wall of the through-channel or coating powder channel running through the hollow affixing element.

10. The spray-coating gun according to claim 1, wherein the filter element is configured as a hollow cylinder and arranged coaxially as well as concentrically to the through-channel or coating powder channel running through the hollow affixing element.

11. The spray-coating gun according to claim 1, wherein the filter element is preferably accommodated in the through-channel or coating powder channel of the hollow affixing element so as to be replaceable.

12. The spray-coating gun according to claim 1, wherein the shaft housing is made of a plastic material, and wherein the coating powder channel extending to the coating powder spray head and/or the compressed gas channel extending to the front end region of the spray-coating gun is/are formed in the plastic material of the shaft housing.

13. The spray-coating gun according to claim 1, wherein the coating powder channel extending to the coating powder spray head is formed by a coating material tube which is insertable into the shaft housing in the longitudinal direction of the shaft.

14. The spray-coating gun according to claim 13, wherein the coating material tube can be affixed by means of the hollow affixing element.

* * * * *